US009738354B2

(12) United States Patent
Van Grieken et al.

(10) Patent No.: US 9,738,354 B2
(45) Date of Patent: Aug. 22, 2017

(54) LIFTING DEVICE, VESSEL AND METHOD FOR REMOVAL AND/OR INSTALLATION OF AT LEAST ONE PART OF A SEA PLATFORM

(71) Applicant: Heerema Marine Contractors Nederland SE, Leiden (NL)

(72) Inventors: Gerardus Cornelius Van Grieken, Leiden (NL); Timotheus Johannes Rutten, Leiden (NL); Chris Van Zeijl, Leiden (NL)

(73) Assignee: HEEREMA MARINE CONTRACTORS NEDERLAND SE, Leiden (NL)

( * ) Notice: Subject to any disclaimer, the term of this patent is extended or adjusted under 35 U.S.C. 154(b) by 0 days.

(21) Appl. No.: 14/906,787

(22) PCT Filed: Jul. 25, 2014

(86) PCT No.: PCT/NL2014/050513
§ 371 (c)(1),
(2) Date: Jan. 21, 2016

(87) PCT Pub. No.: WO2015/012695
PCT Pub. Date: Jan. 29, 2015

(65) Prior Publication Data

US 2016/0159440 A1 Jun. 9, 2016

(30) Foreign Application Priority Data

Jul. 26, 2013 (NL) ..... 2011229

(51) Int. Cl.
*B63B 27/00* (2006.01)
*B63B 27/30* (2006.01)
(Continued)

(52) U.S. Cl.
CPC ..... *B63B 27/30* (2013.01); *B63B 27/10* (2013.01); *B63B 35/003* (2013.01); *B66C 1/44* (2013.01);
(Continued)

(58) Field of Classification Search
CPC ..... B63B 27/10; B63B 27/30; B63B 17/0054; B63B 17/0063; B63B 17/0072;
(Continued)

(56) References Cited

U.S. PATENT DOCUMENTS 5,553,977 A * 9/1996 Andersen ..... B63B 35/003 405/204
5,787,832 A * 8/1998 Spinka ..... B63B 43/14 114/122
(Continued)

FOREIGN PATENT DOCUMENTS

DE 2345280 A1 3/1975
EP 1978185 A1 10/2008
(Continued)

OTHER PUBLICATIONS

Search Report and Written Opinion dated Jan. 5, 2015 for International Application No. PCT/NL2014/050513. (10 pages).
(Continued)

*Primary Examiner* — Mark Beauchaine
(74) *Attorney, Agent, or Firm* — Patterson & Sheridan, L.L.P.

(57) ABSTRACT

The invention provides a lifting device (1) for lifting a leg of at least one part of a sea platform comprising a support structure and a top side, wherein the lifting device comprises: a base structure (2) to be mounted on a vessel; a gripping device (3) to grip the leg, wherein the gripping device is movably supported with respect to the base structure; a support device (4) mounted on the base structure, and
(Continued)

Figure 1:
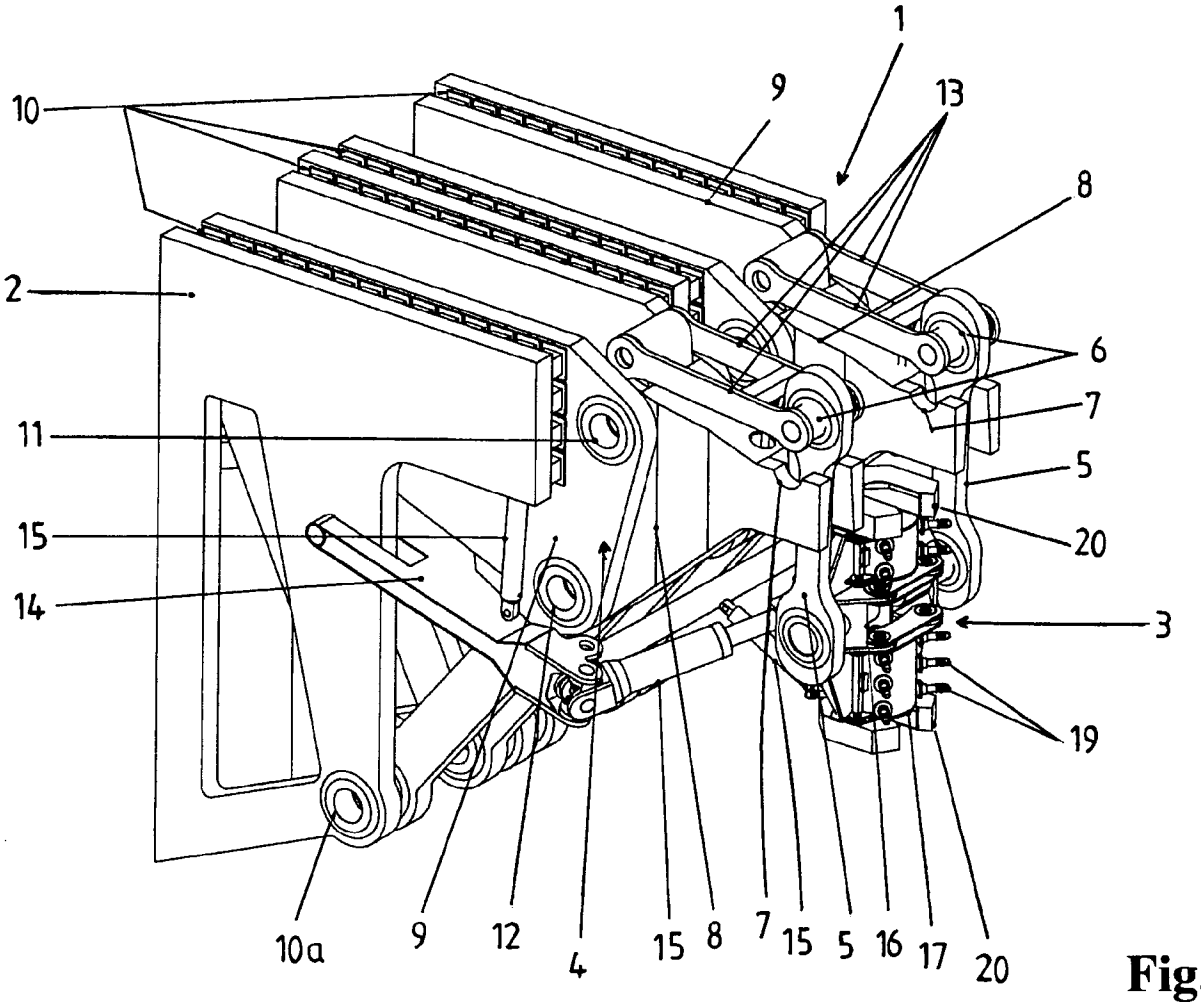

a lifting beam (5), wherein a first end of the lifting beam is configured to be supported at a support location of the support device and wherein a second end of the lifting beam opposite to the first end is configured to be connected to the gripping device.

21 Claims, 10 Drawing Sheets

(51) Int. Cl.

| | |
|---|---|
| ***B66C 1/68*** | (2006.01) |
| ***B66C 1/62*** | (2006.01) |
| ***B63B 35/00*** | (2006.01) |
| ***B66C 1/44*** | (2006.01) |
| ***B63B 27/10*** | (2006.01) |
| *E02B 17/00* | (2006.01) |

(52) U.S. Cl.
CPC ..... *B66C 1/62* (2013.01); *B66C 1/68* (2013.01); *E02B 17/00* (2013.01); *E02B 2017/0052* (2013.01)

(58) Field of Classification Search
CPC B63B 25/006; B66C 1/44; B66C 1/62; B66C 1/625; B66C 1/68; B66F 3/24; B66F 3/35; B66F 3/36; B66F 3/40; B65C 3/06
See application file for complete search history.

(56) References Cited

U.S. PATENT DOCUMENTS

| | | | | |
|---|---|---|---|---|
| 6,183,165 | B1 * | 2/2001 | Heinrichs | E21B 29/005 166/55 |
| 2008/0237174 | A1 * | 10/2008 | Altman | B66C 5/10 212/347 |
| 2013/0152840 | A1 * | 6/2013 | Awashima | F03D 1/001 114/125 |

FOREIGN PATENT DOCUMENTS

| | | | | |
|---|---|---|---|---|
| EP | 2327838 | A2 | 6/2011 | |
| EP | 2559614 | A2 | 2/2013 | |
| GB | 1 518 821 | A * | 7/1975 | B66F 9/18 |
| WO | 2008155664 | A2 | 12/2008 | |

OTHER PUBLICATIONS

Search Report and Written Opinion dated Apr. 11, 2014 for Netherland Application No. NL2011229. (9 pages).

* cited by examiner

LIFTING DEVICE, VESSEL AND METHOD FOR REMOVAL AND/OR INSTALLATION OF AT LEAST ONE PART OF A SEA PLATFORM

This application is the National Stage of International Application No. PCT/NL2014/050513, filed Jul. 25, 2014, which claims benefit of Netherlands Patent Application No. 2011229, filed Jul. 26, 2013.

The invention relates to a lifting device for lifting at least one part of a sea platform comprising a support structure and a top side and a vessel for removal and/or installation of at least one part of a sea platform. The invention further relates to a method for removal and/or installation of at least one part of a sea platform.

US 2013/0045056 discloses a vessel and method for removal and/or installation of at least part of a sea platform, the contents of which is herein incorporated by reference in its entirety. The present invention relates to a lifting device to be used in such vessel. The lifting device may also be used in other suitable application.

There is a general desire to transport large parts of a sea platform, such as a support structure or a top side as a whole to or from an installation location.

It is an object of the invention to provide an improved or at least alternative lifting device for removing and installing at least a part of a sea platform.

This object is achieved by the lifting device and the vessel according to the invention.

It is another object of the invention to provide an improved or at least alternative method for removing and installing at least a part of a sea platform comprising a support structure and a top side.

This object is achieved by the method according to the invention.

In an embodiment, the invention provides a lifting device for lifting of at least one part of a sea platform comprising a support structure and a top side, wherein the lifting device comprises:

a base structure to be mounted on a vessel;

a gripping device to grip a leg or other structural part or feature of the at least one part, wherein the gripping device is movably supported with respect to the base structure;

a support device mounted on the base structure, and a lifting beam, wherein a first end of the lifting beam is configured to be supported at a support location of the support device and wherein a second end of the lifting beam opposite to the first end is configured to be connected to the gripping device.

In an embodiment, the lifting device comprises flexible or elastic elements to provide, in a supporting state of the lifting device, freedom of movement of the gripping device with respect to the base structure. This freedom of movement provided by the flexible or elastic elements may for example be in horizontal directions or in horizontal and vertical directions. The flexible or elastic elements may be passive flexible or elastic elements, such as elastic block elements and/or pivotable elements, such as gimbal devices.

In an embodiment, the lifting beam comprises a support element to cooperate with the support location of the support device, wherein the lifting beam and the support device are movable with respect to each other between a supporting position, in which the support element is located at the support location, and a non-supporting position, in which the support element is spaced from the support location.

In an embodiment, the lifting beam and the support structure have more freedom of movement with respect to each other in the non-supporting position than in the supporting position.

In an embodiment, the support element is a support pin and the support location is formed by a support saddle for the support pin.

The support element, in particular the support pin, may be flexibly mounted to the main beam of the lifting beam. The main beam of the lifting beam is an elongate part of the lifting beam extending from the first end of the lifting beam to be supported at the support location to the second end of the lifting beam connected to the gripping device. The flexible connection may be a gimbal device.

In an embodiment, the lifting beam is pivotably connected on the gripping device. The connection may be provided by a gimbal device to allow pivoting movements of the lifting beam with respect to the gripping device in multiple directions.

In an embodiment, the lifting device comprises a connection beam, wherein a first end of the connection beam is pivotably mounted to the support device and a second end of the connection beam is pivotably mounted to the lifting beam, in particular to the support element of the lifting beam.

In an embodiment, the lifting device comprises two combinations of a support device and a lifting beam at opposite sides of a single gripping device to grip a leg.

In an embodiment, in the supporting state of the lifting device, the support device and/or lifting beam is provided with a device providing spring characteristics to provide freedom of movement of the gripping device with respect to the base structure in the horizontal plane, i.e. one or more horizontal directions, and/or in the vertical direction.

In an embodiment, in the supporting state of the lifting device, the lifting beam is mounted as a pendulum to allow movement of the second end of the lifting beam in a substantially horizontal plane with respect to the support location.

In an embodiment, elastic elements, in particular elastic blocks, are provided within the support device or between the support device and the base structure to allow relative movement of at least part of the support device with respect to the base structure to allow at least a substantially vertical movement of the support location with respect to the base structure.

In an embodiment, the support device is pivotably mounted to the base structure at a pivot axis and one or more elastic elements are mounted between the support device and the base structure at a radial distance from the pivot axis.

In an embodiment, at least a pivotable part of the support device comprising the support location is pivotably movable with respect to the base structure to move the pivotable part between a retracted position, in which the gripping device and lifting beam are relatively close to the base structure, and a support position, in which the pivotable part is arranged to support the lifting beam.

In an embodiment, the lifting device comprises a positioning device for positioning the gripping device with respect to the leg.

In an embodiment, the positioning device comprises a position control system to actively control the position of the gripping device in particular in order to compensate for motions of the base structure.

In an embodiment, the position control system comprises:

at least one sensor to determine a position of the gripping device with respect to the base structure, a controller to provide one or more actuation signals on the basis of the determined position, and at least one actuator to actuate on the gripping device to control a relative position of the gripping device with respect to the base structure.

In an embodiment, the controller is configured to control and maintain a position of the gripping device independent of wave-induced motions of the base structure.

In an embodiment, the position control system can be switched between an active mode, in which a position of the gripping device with respect to the base structure is actively controlled, and a passive mode, in which the gripping device is allowed to freely move with respect to the base structure within limits of freedom of movement provided by the position control system.

In an embodiment, the position control system is configured to control a position of the gripping device in three degrees of freedom, preferably in six degrees of freedom.

In an embodiment, the at least one actuator is an assembly of hydraulic actuators to move the gripping device with respect to the base structure.

In an embodiment, the gripping device comprises a main body and at least one shell element rotatably mounted to the main body, wherein the at least one shell element is movable between a closed position, in which the at least one shell element and the main body enclose a leg receiving space to receive a leg therein, and an open position in which a leg can be brought into or taken out of the leg receiving space.

In an embodiment, wherein the gripping device is configured to grip the leg to allow the lifting of the leg.

In an embodiment, the gripping device comprises multiple drill elements configured to be drilled in the leg in order to grip the leg.

In an embodiment, the gripping device comprises a temporary clamping device to clamp the leg at least before and during drilling of the drill elements into the leg.

In an embodiment, the invention provides a method of lifting a leg of at least one part of a sea platform comprising a support structure and a top side, the method comprising the steps of:

providing a lifting device, moving the lifting device towards the leg, positioning by a positioning device the gripping device on the leg and gripping the leg, moving the base structure upwards to support the lifting beam at the support location of the support device, and moving the base structure upwards to lift the leg.

In an embodiment, positioning of the gripping device comprises one or more of the steps of:

actively controlling, by a position control system in an active mode, the position of the gripping device, in particular in order to compensate for motions of the base structure, such as wave-induced motions of the base structure, during positioning of the gripping device on the leg and/or gripping the leg;

switching from an active mode to a passive mode after positioning of the gripping device on the leg and/or gripping the leg, wherein in the passive mode the gripping device is allowed to freely move with respect to the base structure within limits of freedom of movement provided by the position control system.

In an embodiment, gripping the leg comprises one or more of the steps of:

wherein the gripping device comprises a main body and at least one shell element pivotably mounted to the main body, wherein the at least one shell element is movable between an open position in which a leg can be brought into or taken out of a leg receiving space, and a closed position, in which the shell element together with the main body encloses the leg receiving space to receive a leg therein, and receiving the leg in the leg receiving space when the shell element is in the open position and moving the at least one shell element to the closed position to enclose the leg in the leg receiving space;

drilling multiple drill elements of the gripping device into the leg to grip the leg; and/or temporary clamping with a temporary clamping device to clamp the leg at least before and during drilling of the drill elements into the leg.

In an embodiment, moving the base structure upwards to support the lifting beam at the support location of the support device, comprises one or more of the steps of:

moving the lifting beam with respect to the support device from a non-supporting position, in which a support element of the lifting beam is spaced from the support location to a supporting position, in which the support element is located at the support location.

In an embodiment, the invention provides a vessel for removal and/or installation of at least one part of a sea platform comprising a support device and a top side, said vessel comprising a hull and two support arms located at a distance from each other and attached to the hull, wherein the support arms in use extend beyond the hull in a substantially horizontal direction, wherein each of the support arms carries at least one lifting device.

In an embodiment, the vessel comprises a ballast system constructed and arranged to lower and raise the vessel relative to the water surface.

In an embodiment, the invention provides a method for lifting at least one part of a sea platform using a vessel, comprising the steps of:

positioning the support arms at opposite sides of the sea platform;

positioning by a positioning device multiple gripping devices on multiple legs and gripping the multiple legs, raising the support arms, preferably relatively quick, to support the lifting beam at the support location of the support device, transferring substantially all load to the support arms, and raising the support arms, preferably relatively quick, to lift the at least one part of the sea platform.

In an embodiment, raising of the support arms comprises releasing ballast water from ballast tanks of a ballast system of the vessel, in particular dumping ballast water.

In this application a lifting device for gripping and lifting a leg of a sea platform is described. Instead of a leg, any other structural part or feature of a sea platform that is suitable to be gripped to lift at least one part of a sea platform, such as a top side or support structure, may also be gripped and lifted by the lifting device.

Further characteristics and advantages of the invention will now be explained, whereby reference is made to the appended drawings, in which an embodiment of the invention is shown in more detail.

Figure 10:
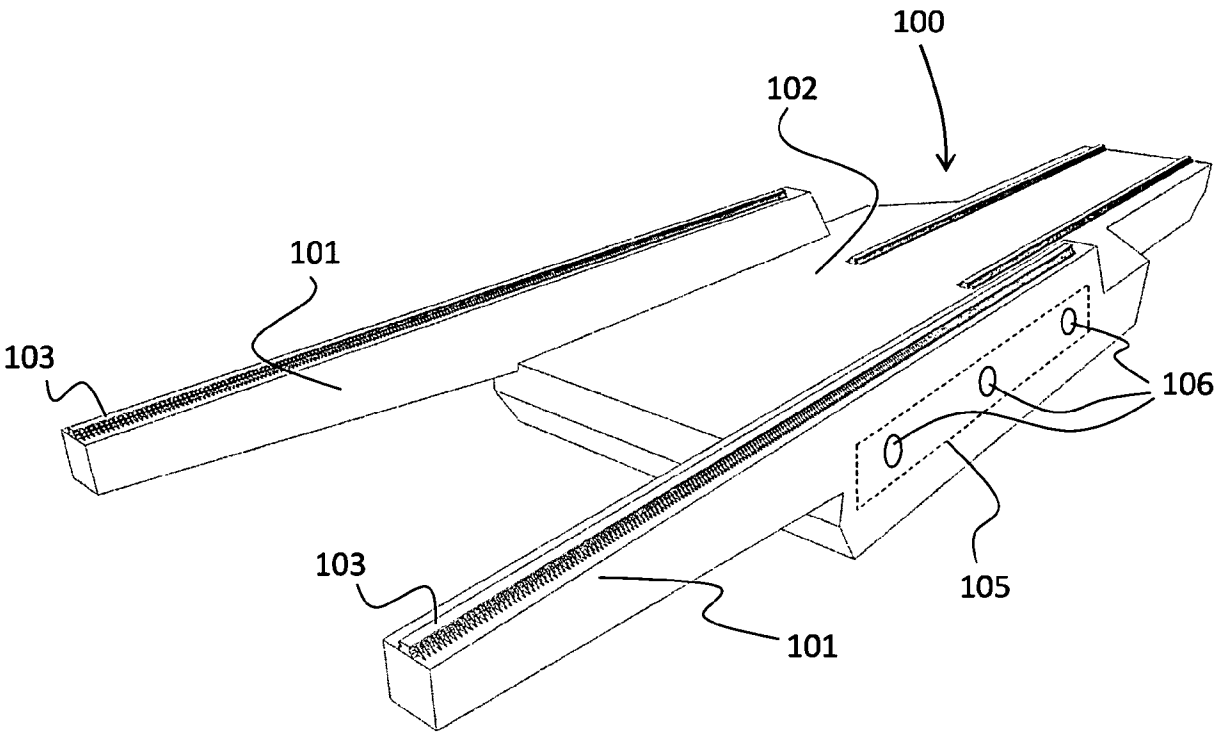

FIG. 1 shows a perspective view of a lifting device according to the invention;

FIGS. 2*a*-2*d* show schematic top views of the gripping device;

FIGS. 3-9 show schematic side views of the lifting device of FIG. 1; and FIG. 10 shows a vessel for mounting a number of lifting devices according to the invention;

FIG. 1 shows a perspective view of a lifting device 1 for lifting a leg 50 of at least one part of a sea platform comprising a support structure and a top side. The lifting device 1 comprises a base structure 2 mounted on a vessel, for example on support arms 101 of a vessel 100, as shown in FIG. 10. The base structure 2 comprises three base support plates mounted parallel to each other and extending in a vertical plane. The lifting device 1 further comprises a gripping device 3 to grip the leg 50. At each of opposite sides of the gripping device 3, a support device 4 and a lifting beam 5 are mounted.

At a first end of the lifting beam 5, a support pin 6 is provided. The support pin 6 is configured and arranged to be received at a support location of the support device 4. The support location is formed by support saddles 7. A second opposite end of the lifting beam 5 is connected to the gripping device 3. The connection between the support pin 6 and the main beam of the lifting beam 5 as well as the connection between the second end of the lifting beam 5 and the gripping device 3 are gimbal devices which allow pivoting in multiple directions of the main beam of the lifting beam 5 with respect to the support pin 6 and the gripping device 3.

The support device 4 comprises a pivotable support part 8 comprising the support saddles 7 and a fixed support part 9 comprising two fixed support plates. Each of the fixed support plates of the fixed support part 9 is mounted by elastic elements 10 and a pivot axis 10*a* on the base structure 2. The elastic elements are designed to allow some movement of the fixed support part 9 with respect to the base structure 2 in a horizontal direction while vertical forces on the fixed support part 9 are transferred to the base structure 2 via the pivot axis 10*a*. The movement of the fixed support part 9 in horizontal direction allowed by pivoting of the fixed support part 9 about the pivot axis 10*a* may be used to allow a substantially vertical displacement of the support saddle 7 in dependence of the load exerted by the lifting beam 5 on the support saddles 7.

In the shown embodiment, the elastic elements 10 are provided as a matrix of rubber block elements. The rubber block elements may for example have dimensions of 0.5 m to 1 m in either direction, and may allow a shear deflection of 0.5 m-1 m. In an embodiment, the rubber block elements may have a cross section of 0.6 m by 0.6 m and a height of 0.7 m and may allow a shear deflection of approximately 0.6 to 0.65 m.

The fixed support part 9 pivotably supports the pivotable support part 8 at a support device pivot axis 11. The pivotable support part 8 is pivotable between a retracted position, shown in FIG. 3, in which the gripping device 3 and the lifting beam 5 are relatively close to the base structure 2, and a support position, shown in FIG. 1, in which the pivotable support part is arranged to support the lifting beam 5. A hydraulic cylinder or other actuator, preferably linear actuator may be provided to move the pivotable support part 8 between the retracted position and the support position.

A pivotable support part locking device may be provided to lock a position of the pivotable support part 8 with respect to the fixed support part 9. This pivotable support part locking device may for example be a hydraulically actuated locking pin mounted to the fixed support part 9 that can be arranged in a locking hole 12 in the pivotable support part 8 when the pivotable support part 8 is arranged in the support position. Placing the locking pin in the locking hole 12 will lock the relative position of the pivotable support part 8 with respect to the fixed support part 9 resulting in a fixed relative position of the pivotable support part 8 and the fixed support part 9.

A connection beam 13 is provided between the pivotable support part 8 and the lifting beam 5. A first end of the connection beam 13 is pivotably mounted to the pivotably support part 8 and an opposite second end of the connection beam is pivotably mounted to the support pin 6 of the lifting beam 5.

By pivoting movement of the connection beam 13, the support pin 6 is movable with respect to the support saddles 7 between a supporting position, in which the support pin is arranged on the support saddles 7, and a non-supporting position, shown in FIG. 1, in which the support pin 6 is spaced from the support saddles 7. A hydraulic actuator may be provided to move the lifting beam 5 in vertical direction and hold the support pin spaced from the support saddles 7. This hydraulic actuator may also be used to control the vertical position of the gripping device 3 with respect to the leg 50.

In both the non-supporting position and the supporting position, the gripping device 3 may have some freedom of movement with respect to the base structure 2 to compensate movements of the base structure 2, in particular wave-induced movements of the base structure 2. However, the freedom of movement of the gripping device 3 with respect to the base structure 2 non-supporting position may be substantially larger than the freedom of movement of the gripping device 3 with respect to the base structure 2 in the supporting position, in particular in the vertical direction.

For example, in the non-supporting position, the lifting device 1 may allow a maximal vertical displacement of +/−1 m of the gripping device 3 with respect to the base structure 2 while in the supporting position, the lifting device 1 may allow a maximal vertical displacement of +/−0.3-0.5 m. This difference in vertical displacement is mainly caused by the fixed position of support pin 6 the lifting beam 5 with respect to the support saddles 7 in the supporting position, while the non-supporting position may allow a change in the spacing between the support pin 6 and the support saddles 7.

The lifting device 1 comprises a positioning device 14 for positioning the gripping device 3 with respect to the leg 50. The positioning device 14 comprises an assembly of hydraulic actuators 15 that are configured to move the gripping device 14 in at least three degrees of freedom, i.e. in a horizontal plane and in vertical direction with respect to the base structure.

The positioning device 14 comprises a position control system to actively control the position of the gripping device 3. Such active positioning of an element is known in the art and used to compensate for motions of a vessel, such as wave-induced motions of the base structure 2. The active positioning may be used to place the gripping device 3 on a desired location of the leg 50. During placement of the gripping device 3, the base structure 2 may make movements due to waves, while the leg which is supported on the bottom of the sea will not make such movements. By the active positioning the position of the gripping device 3 can be decoupled from the wave-induced movements of the base structure 2.

The position control system may comprise one or more sensors to determine a position of the gripping device 3 with respect to the base structure 2. These sensors may for example be arranged in each of the hydraulic actuators of the assembly of hydraulic actuators 15, since from the positions of the pistons with respect to the cylinders of each of the hydraulic actuators, the position of the gripping device 3 with respect to the base structure 2 can be determined. Any other type of sensor to determine a relative position of the gripping device with respect to the base structure 2 may also be used.

The position control system further comprises a controller to provide actuation signals for each of the actuators of the assembly of hydraulic actuators 15 on the basis of the determined position of the gripping device 3. The actuation signals are fed to the respective actuators of the assembly of hydraulic actuators 15 to position the gripping device 3 in a desired position with respect to the leg 50.

The position control system can be switched between an active mode, in which a position of the gripping device 3 with respect to the base structure 2 is actively controlled, and a passive mode, in which the gripping device 3 is allowed to freely move with respect to the base structure 2. This free movement of the gripping device 3 means that the hydraulic cylinders 15 do not prevent movement of the gripping device 3 within the limits of freedom of movement provided by the position control system itself, i.e. the movement of the gripping device 3 with respect to the base structure 2 is limited by the respective strokes of the hydraulic cylinders 15. These maximum strokes may for example be +/−0.5-1.5 m Generally, the active positioning of the gripping device 3 will be used to bring the gripping device 3 in a desired position with respect to the leg 50. As soon as the gripping device 3 holds the leg 50, the position control system can be switched from active mode to passive mode in which the actuators 15 allow free movement of the gripping device 3 and the base structure 2 with respect to each other.

FIGS. 2*a*-2*d* show the gripping device 3 in more detail.

The gripping device 3 comprises a main body 16 and two shell elements 17 that are rotatably mounted to the main body 16. The shell elements 17 are movable between an open position and a closed position. In the closed position (FIG. 2*c*) the main body and the shell elements 17 define and enclose a leg receiving space 18 to receive the leg 50 therein. In the open position of the shell elements 17 (FIG. 2*a*) the leg can be brought into or taken out of the leg receiving space 18.

In the main body 16 and the shell elements 17, drill elements 19 are provided. The drill elements 19 are configured to be drilled into the leg 50 to grip the leg 50 and make lifting of the leg 50 possible. In alternative embodiments other means, may be provided to grip the leg 50. For example, the gripping device may be configured to grip a flange arranged on the leg, or the gripping device may have a clamp to exert a clamping force to be able to lift the leg. The use of clamping forces may have the drawback, in particular in a removal of a sea platform, that special measures have to be taken to reliably clamp the leg 50. Such special measures are normally not required when gripping the leg with a griping device 3 comprising drill elements 19 which makes a griping device 3 with drill elements 19 in particular suitable for removal of existing structures.

The gripping device 3 further comprises a temporary clamping device 20 to clamp the leg 50 at least before and during drilling of the drill elements 19 into the leg 50 so that the gripping device 3 can be held at a fixed location with respect to the leg 50 without the need of active positioning of the gripping device 3 with respect to the leg 50. In an embodiment, a temporary clamping device 20 is provided at the top and the bottom of the gripping device 3.

Multiple lifting devices 1 as described above may be mounted on a vessel in order to lift at least one part of a sea platform, such as a support structure or a top side to transport the at least one part as a whole to or from an installation location. The support structure may for example comprise a frame work or one or more support legs. The top side may for example comprise equipment for exploitation of oil and/or gas from the seabed or a wind turbine for producing electricity.

As an example, the steps of lifting a top side of a sea platform as a whole for removal of such top side using multiple lifting devices 3 will be described hereinafter. FIG. 10 shows a vessel 100 comprising two support arms 101 that extend horizontally from the hull 102 of the vessel 100. The support arms 101 may be arranged at opposite sides of a sea platform, and may be movable relative to each other and the hull of vessel 100. To lift the top side from the support structure lifting devices 3 may be mounted on the support arms 101. The shown vessel 100 comprises rails 103 such that the lifting devices 3 may be moved in longitudinal direction of the support arms 101 to align the lifting devices 3 with a respective leg 50 to be lifted.

The top side may be lifted by simultaneously lifting multiple legs, wherein each leg of the multiple legs is gripped and lifted by a lifting device 3 as described above. For lifting a complete top side 6 to 12 lifting devices 1 may for example be used. Each of the lifting devices may have a vertical capacity of at least 2000 mT, preferably at least 5000 mT, and a horizontal capacity of at least 200 mT, preferably at least 500 mT.

The vessel 100 comprises a ballast system 105 constructed and arranged to lower and raise the vessel 1 relative to the water surface. For lowering the vessel 1, sea water is taken in by the ballast system 105 and stored in ballast tanks. For raising the vessel 1, the sea water is released from the ballast system 105. Several outflow openings 106 are provided to rapidly discharge the water held in the ballast tanks. The ballast tanks may be located above the water surface. This allows the use of gravity for rapidly discharging the sea water from the ballast system. The outflow openings 106 may also be located above the water surface in order to facilitate the rapid removal of sea water from the ballast system 105.

For further details on the construction of the vessel, in particular the support arms and ballast system and use thereof reference is made to US 2013/0045056, the contents of which is herein incorporated by reference in its entirety.

The steps of lifting a leg 50 with the lifting device 3 will now be described in more detail with reference to FIG. 3-9.

Figure 3:
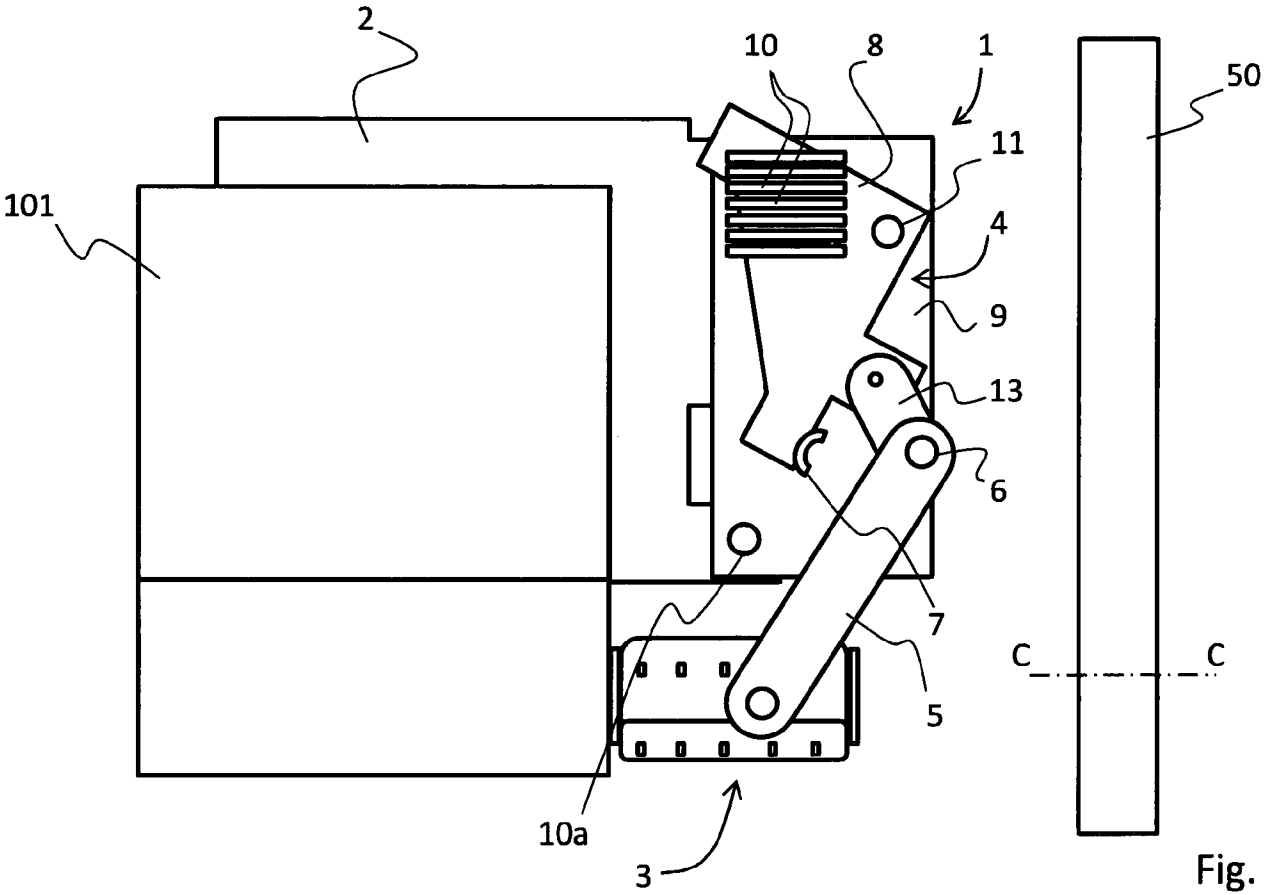
Figure 4:
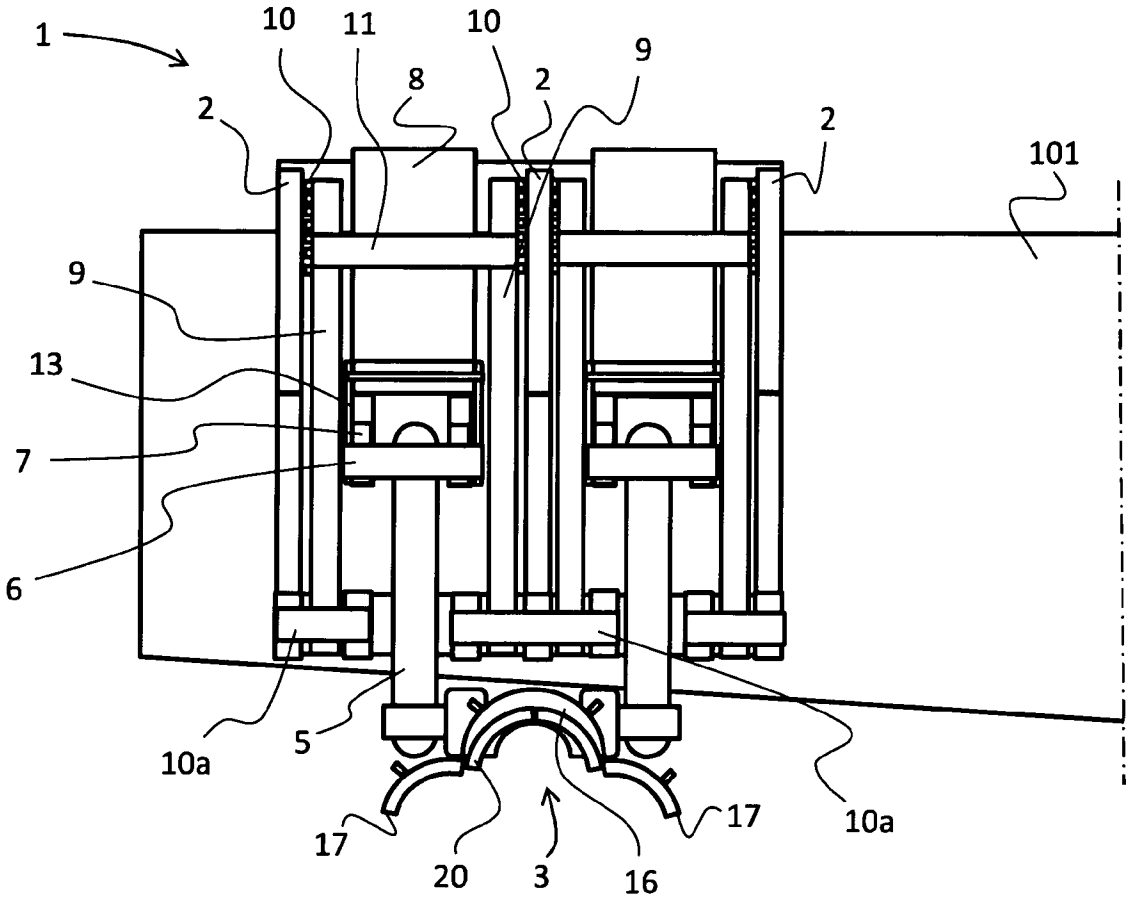

In FIGS. 3 and 4, the lifting device 1 is shown in a retracted position. The pivotable support part 8 is placed in the retracted position and the gripping device 3 is held below the support device 4. In this retracted position there is some distance of for example 2 to 6 m between the lifting device 1 and the leg 50. The shell elements 17 of the gripping device 3 are arranged in the open position in order to receive a leg 50 in the leg receiving space 18.

The distance between lifting device 1 and leg 50 in the retracted position may for example be useful for positioning support arms 101 of a vessel 100 on which the lifting devices 1 are mounted at opposite sides of a sea platform. Once the vessel 100 is properly positioned with respect to the sea platform, the vessel 100 may be docked against the sea platform, for example with fenders between stern of the vessel 100 and platform legs 50. Docking of the vessel 100 provides additional position control of the vessel 100 with respect to the sea platform. The lifting devices 1 are mounted movably on the support arms 101 of the vessel 100, such that the lifting devices 1 can be independently moved to align the respective lifting devices with the leg 50 to be lifted.

A section line C-C shows where the leg 50 is cut or will be cut to lift a top side from a support structure. The part of the leg 10 above the section line C-C belongs to the top side and the part below the section line C-C belongs to the support structure of the sea platform. The cuts of the legs 50 can be made before the vessel 100 is positioned with respect to the sea platform to lift the top side, or can be made once the vessel 100 is positioned.

Figure 5:
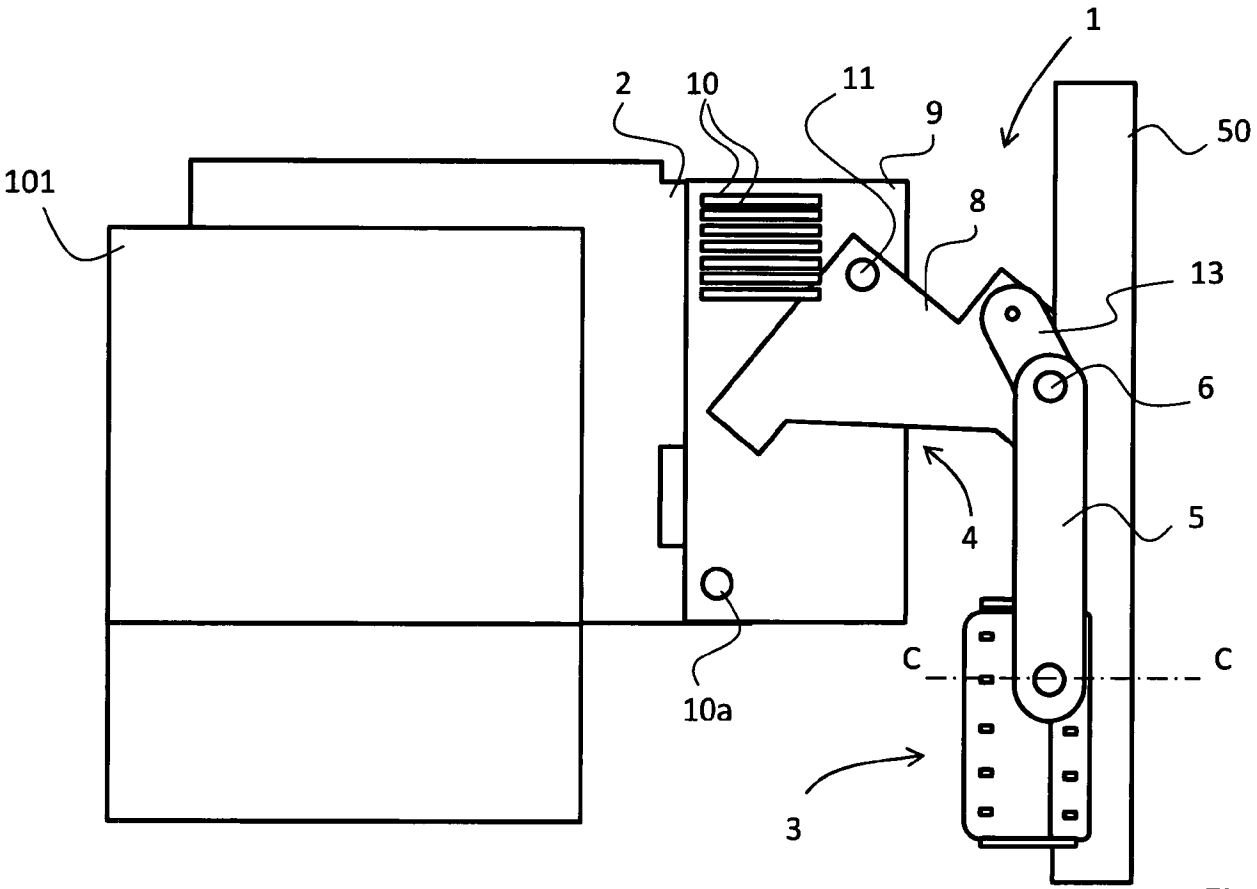

When the lifting device 1 is aligned with the leg 50, the pivotable support part 8 can be moved from the retracted position of FIGS. 3 and 4 to the support position. FIG. 5 shows the pivotable support part 8 during movement of the retracted position to the support position. During this movement the gripping device 3 is moved towards the leg 50 and active positioning of the gripping device 3 using the position control system is used to control the position of the gripping device 3 with respect to the leg 50. It is remarked that in this movement the gripping device 3 is moved from a lower position to a higher position. Such movement may be advantageous in view of the available space for approaching a leg 50 of a sea platform.

Figure 6:
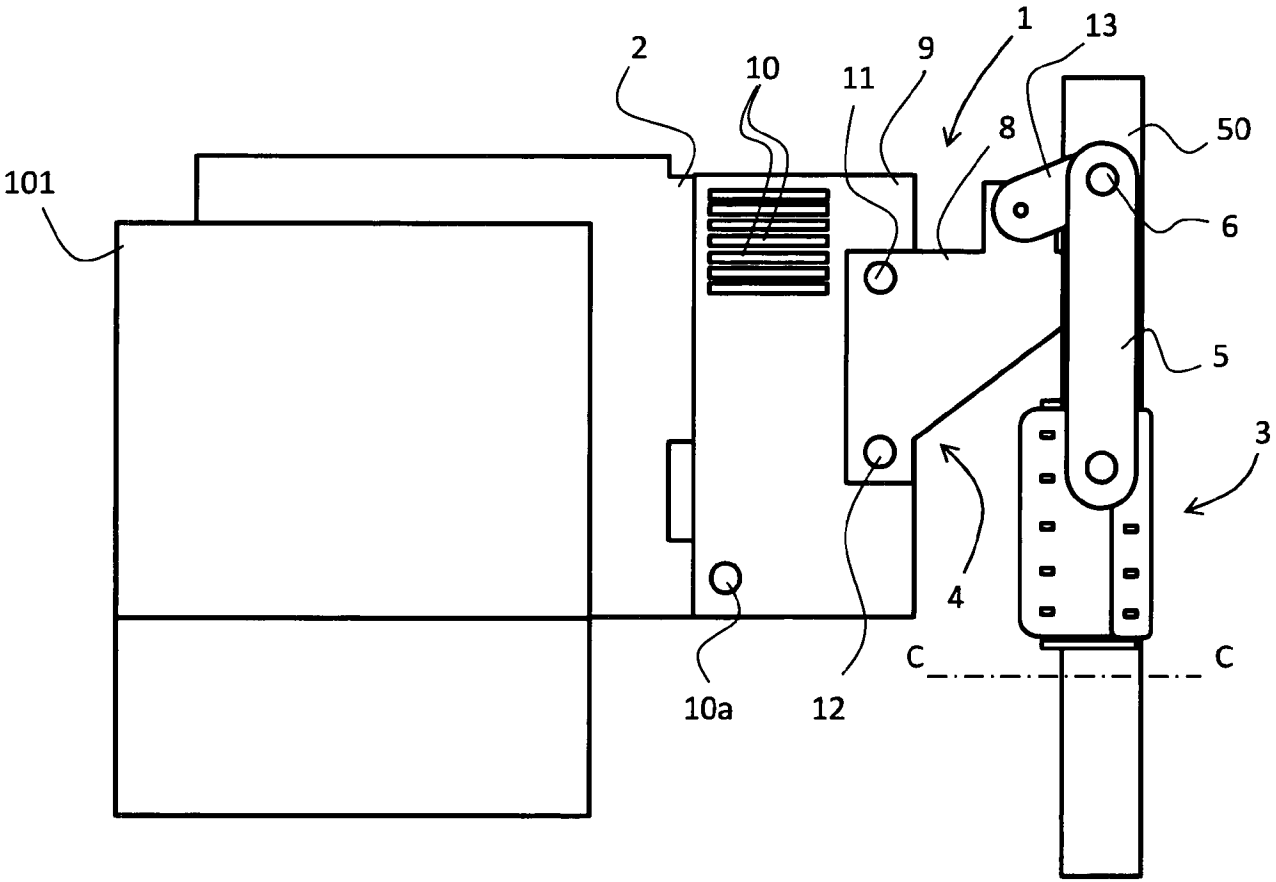

In FIG. 6 the pivotable support part 8 is arranged in the support position. As soon as the pivotable support part 8 is in the support position, the locking pin of the pivotable support part locking device is arranged in the locking hole 12 to lock the relative position of the pivotable support part 8 with respect to the fixed support part 9.

Further, in FIG. 6 the positioning device has positioned the gripping device at the desired location on the leg 50 such that the leg 50 is received in the leg receiving space 18. In this position the gripping device 3 is not yet held by the gripping device 2 and therefore the position of the gripping device 3 is still actively controlled to compensate for motions, in particular wave-induced motions, of the base structure 2.

Figure 2A:
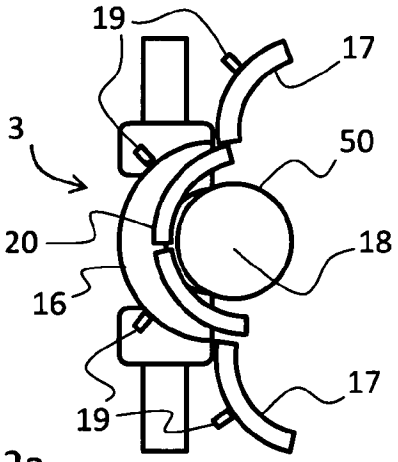
Figure 2B:
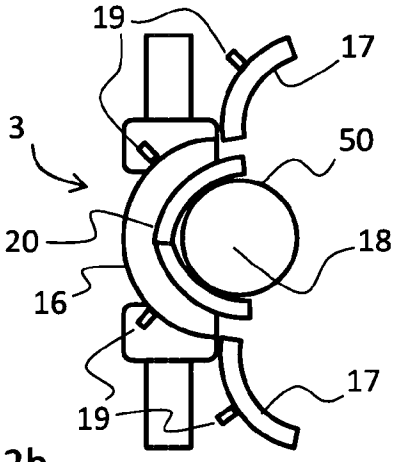

FIG. 2*a* shows a top view of this position of the gripping device 3. As a first step to grip the leg 50 for lifting, the temporary clamping device 20 is actuated to clamp the leg 50. FIG. 2*b* shows the resulting position of the gripping device 3. The temporary clamping device 20 can provide sufficient clamping force to hold the gripping device at a fixed location with respect to the leg 50. This clamping force should at least be sufficient to bear the weight of the gripping device 3 itself and the lifting beams 5 and (partly) the connection beams 13 at opposite sides of the gripping device 3.

When the temporary clamping device holds the leg 50, active positioning of the gripping device 3 is no longer required and the position control system can be switched to passive mode. However, the position control system may also be held in active mode.

Figure 2C:
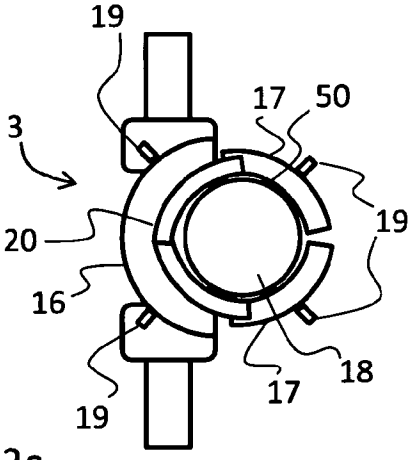
Figure 2D:
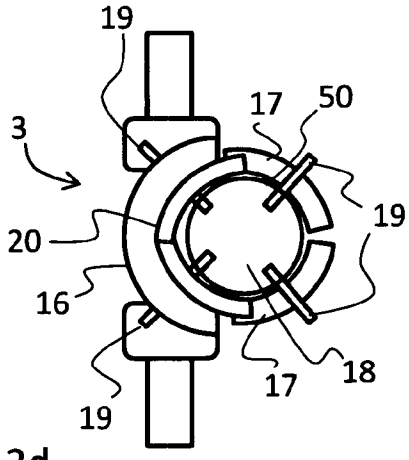

As a next step, shown in FIG. 2*c*, the shell elements 17 of the gripping device 3 are moved to the closed position to enclose the leg 50 in the leg receiving space 18 by the main body 16 and the shell elements 17. Finally, the drill elements 19 are drilled into the leg 50, as shown in FIG. 2*d*, to provide a firm connection between the gripping device 3 and the leg 50 that allows lifting of the leg 50 by the lifting device 1.

The gripping device now holds the leg 50 and the position control system is in passive mode allowing free movement of the gripping device 3 with respect to the base structure 2. The lifting beam 5 is in the non-supporting position in which the support pin 6 is spaced from the support saddles 7.

To absorb vertical movements of the gripping device 3 with respect to the base structure 2, the lifting beam 5 may move together with the gripping device 3 in a substantial vertical direction. The connection beam 13 provides a movable connection between the pivotable support part 8 and the lifting beam 5 which allows such movement in vertical direction. Since the support pin 6 is spaced from the support saddles 7, the lifting beam 5 may displace over a relative large vertical distance with respect to the pivotable support part 8, therewith allowing a relative large displacement in vertical direction of the gripping device 3 with respect to the base structure 2.

Movements of the gripping device 3 in the horizontal plane with respect to the base structure 2 can be absorbed by the gimbal devices with which the main beam of the lifting beam 5 is mounted between the support pin 6 and the gripping device 3. As a result of these gimbal devices, the lifting beam functions as a pendulum, whereby the gripping device 3 can swing sideways in the horizontal plane while the support pin 6 can remain in substantially the same position.

Figure 7:
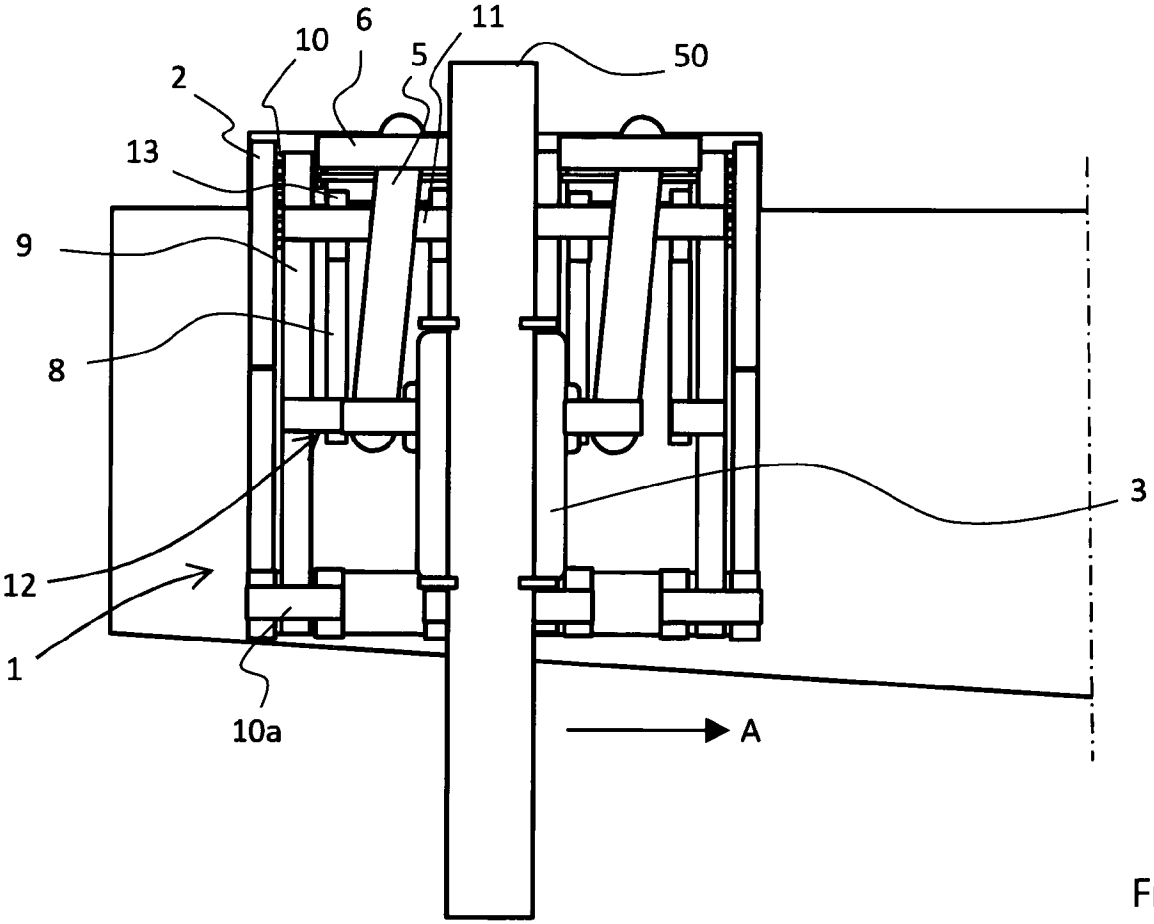

FIG. 7 shows a side view of the lifting device 1 in which the gripping device 3 holds the leg 50, and wherein the base structure 2 has moved with respect to the gripping device 3 in the direction indicated by the arrow A. It can be seen that the lifting beams 5 are no longer positioned in vertical direction, but are tilted with respect to the vertical to absorb the horizontal movement of the base structure 2. This tilting is possible in any horizontal direction due to the gimbal devices. However, any other suitable pivot or tilt device to provide a pendulum like function to the lifting beam 5 may also be applied.

The above steps for gripping a leg are taken for each of the lifting devices 1 until all lifting devices 1 used to lift the top side of the sea platform have gripped the respective leg 50. Such process of gripping 8 legs 50 with 8 lifting devices 1 may for example take 2-3 hours.

Figure 8:
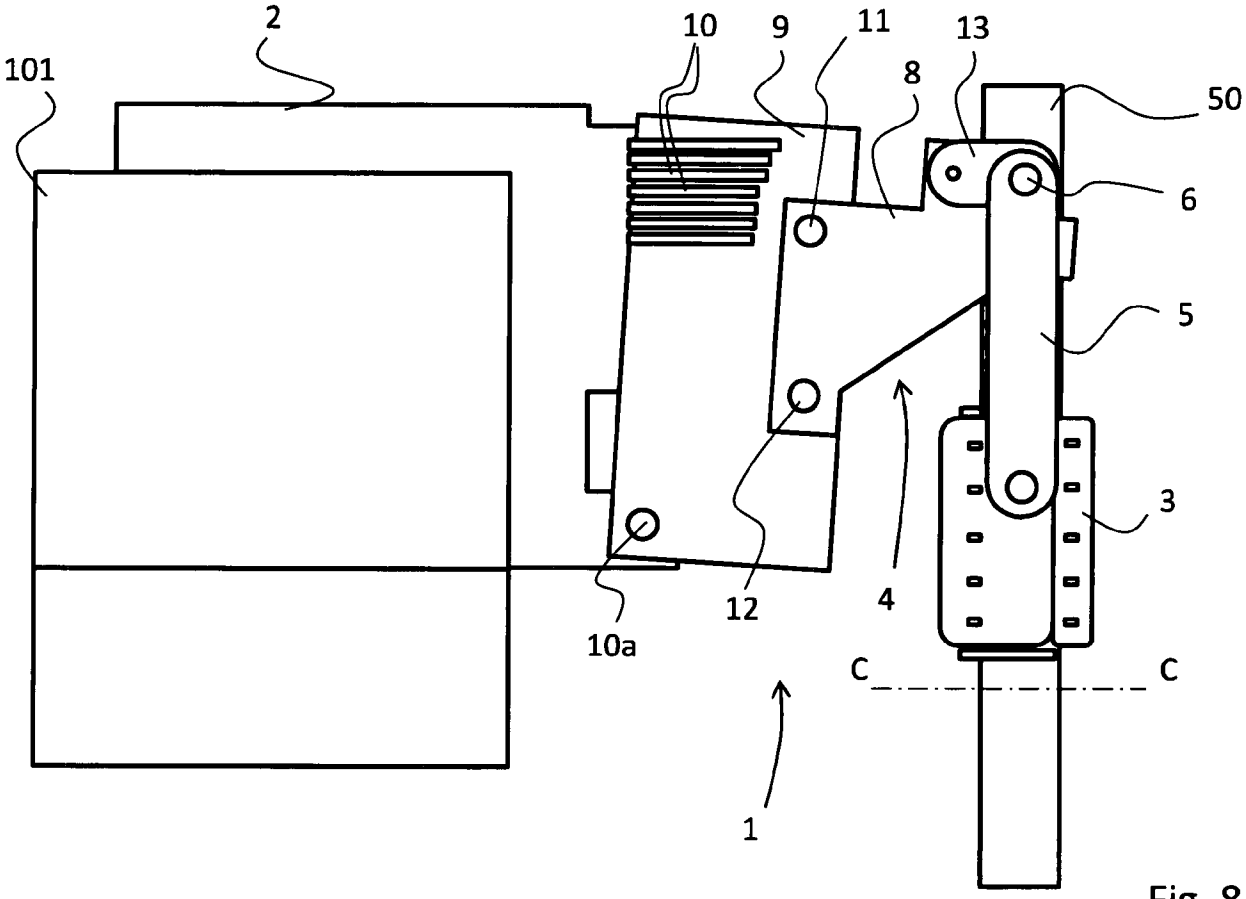
Figure 9:
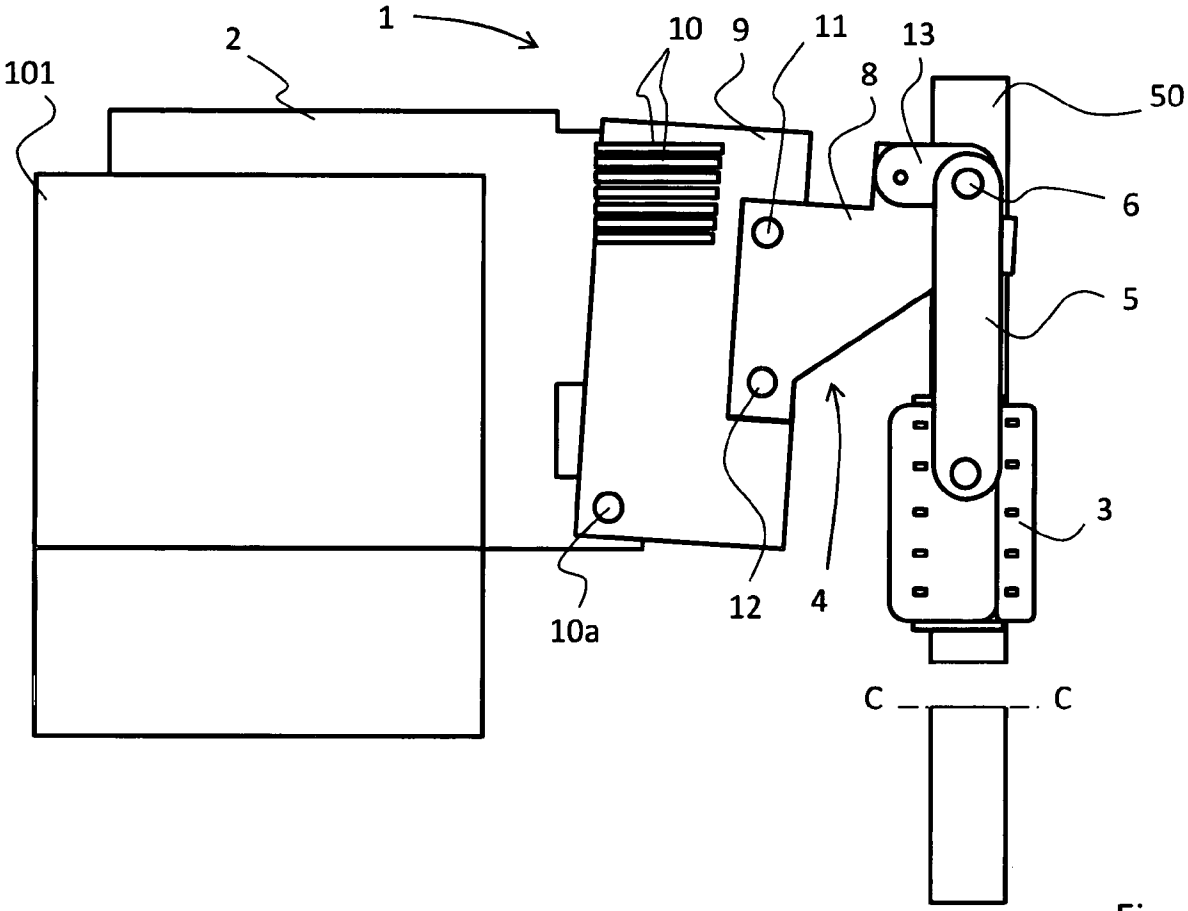

As a next step the base structure 2 is actively raised to bring the lifting beam 5 from the non-supporting position of FIG. 6 to the supporting position as shown in FIG. 8. In this supporting position the support pin 6 comes to rest on the support saddles 7 to be able to transfer lifting forces from the lifting beam 5 to the support device 4.

The base structure 2 is preferably raised by using the ballast system 105 of the vessel 101. The movement of the lifting beam 5 from the non-supporting position to the supporting position is preferably performed as quickly as possible, and may for example be performed within a period of 30 seconds to 2 minutes.

In the supporting position of the lifting beam 5, the support pin 6 directly supports on the support saddles 7. As a result, the spacing in the non-supporting position between the support pin 6 and the support saddles 7 can no longer be used to compensate for vertical movements of the gripping device 3 with respect to the base structure 2. It is advantageous to make the support pin 6 to exert at least a minimum force on the support saddle to avoid that the support pin will move out of the support saddles 7 as a result of a sudden change in this force, for example cause by waves. This minimum force may be at least 3000 kN, for example 4000-6000 kN.

In the support position, however, compensation of relative vertical movements of the gripping device 3 with respect to the base structure 2 is still desirable in view of the large forces that may be exerted on the leg 50 when the movements of the base structure 2 are directly transferred to the leg 50. For this reason, the elastic elements 10 are provided between the fixed support part 8 and the base structure 2. When a load is exerted on the support saddles 7 by the support pin 6, this load may result in a shear deflection of the elastic elements 10 in the horizontal direction, while the support device 4, i.e. the combination of pivotable support part 8 and fixed support part 9 may pivot about pivot axis 10*a* to allow this movement in the horizontal direction. This pivoting movement of the support structure about the pivot axis 10*a* results in a vertical movement of the combination of support pin 6 and support saddles 7, thus allowing a movement in vertical direction of the gripping device 3 with respect to the base structure 2. This vertical movement of the support pin 6 and support saddles 7 may for example be in the range of +/−0.3-0.5 m.

After the lifting beam 5 is supported at the support pin 6 on the support saddles 7, the load of the top side of the sea platform may gradually be transferred from the support structure to the vessel 100 by raising the support arms 101 of the vessel using the ballast system 105.

When almost the entire load of the top side has been transferred from the support structure to the vessel 1 the last step of lifting the top side of the support structure may be performed. To avoid premature release of the top side from the support structure, a relative small load of for example at least 3000 kN, such as 4000-6000 kN is maintained before the actual lifting is started. The actual lifting is carried out by dumping of ballast water from the ballast system 105 such that the support arms 101 quickly raise and lift the top side of the support structure with sufficient distance to avoid collision of the top side and the support structure, once released.

The minimum clearance between the support structure and the top side obtained during the actual lifting of the top side is for example at least 0.5 m, such as approximately 1 m. The actual lifting may also be performed within a period of 30 seconds to 2 minutes.

Once the top side is lifted from the support structure, the vessel may sail to a location which is more suitable for deconstruction of the top side.

The following clauses form a further description of the lifting device, the vessel, and the method according to the invention.

1. A lifting device for lifting a leg of at least one part of a sea platform comprising a support structure and a top side, wherein the lifting device comprises:

a base structure to be mounted on a vessel;

a gripping device to grip the leg, wherein the gripping device is movably supported with respect to the base structure;

a support device mounted on the base structure, and a lifting beam, wherein a first end of the lifting beam is configured to be supported at a support location of the support device and wherein a second end of the lifting beam opposite to the first end is configured to be connected to the gripping device.

2. The lifting device of clause 1, wherein the lifting device comprises elastic or flexible elements to provide, in a supporting state of the lifting device, freedom of movement of the gripping device with respect to the base structure.

3. The lifting device of clause 1, wherein the lifting beam comprises a support element to cooperate with the support location of the support device, wherein the lifting beam and the support device are movable with respect to each other between a supporting position, in which the support element is located at the support location, and a non-supporting position, in which the support element is spaced from the support location.

4. The lifting device of clause 3, wherein the lifting beam and the support structure have more freedom of movement with respect to each other in the non-supporting position than in the supporting position.

5. The lifting device of clause 3 or 4, wherein the support element is a support pin and wherein the support location is formed by a support saddle for the support pin.

6. The lifting device of any of the clauses 3-5, wherein the lifting beam is pivotably connected to the gripping device.

7. The lifting device of any of the clauses 3-6, wherein the lifting device comprises a connection beam, wherein a first end of the connection beam is pivotably mounted to the support device and a second end of the connection beam is pivotably mounted to the lifting beam, in particular to the support element of the lifting beam.

8. The lifting device of any of the preceding clauses 6, wherein the lifting device comprises two combinations of the support device and the lifting beam at opposite sides of a single gripping device to grip a leg.

9. The lifting device any of the preceding clauses, wherein, in the supporting state of the lifting device, the support device and/or lifting beam is provided with a device providing spring characteristics to provide freedom of movement of the gripping device with respect to the base structure in the horizontal plane and/or in the vertical direction.

10. The lifting device of any of the preceding clauses, wherein, in the supporting state of the lifting device, the lifting beam is arranged as a pendulum to allow movement of the second end of the lifting beam in a substantially horizontal plane with respect to the support location.

11. The lifting device of clause 2, 9 or 10, wherein elastic elements, in particular elastic blocks, are provided within the support device or between the support device and the base structure to allow relative movement of at least part of the support device with respect to the base structure to allow at least a substantially vertical movement of the support location with respect to the base structure.

12. The lifting device of any of the preceding clauses, wherein at least a pivotable part of the support device comprising the support location is pivotably movable with respect to the base structure to move the pivotable part between a retracted position, in which the gripping device and lifting beam are relatively close to the base structure, and a support position, in which the pivotable part is arranged to support the lifting beam.

13. The lifting device of any of the preceding clauses, wherein the lifting device comprises a positioning device for positioning the gripping device with respect to the leg.

14. The lifting device of the preceding clause, wherein the positioning device comprises a position control system to actively control the position of the gripping device in particular in order to compensate for motions of the base structure.

15. The lifting device of the preceding clause, wherein the position control system comprises:

at least one sensor to determine a position of the gripping device with respect to the base structure, a controller to provide one or more actuation signals on the basis of the determined position, and at least one actuator to actuate on the gripping device to control a relative position of the gripping device with respect to the base structure.

16. The lifting device of clause 15, wherein the controller is configured to control and maintain a position of the gripping device independent of wave-induced motions of the base structure.

17. The lifting device of clause 15 or 16, wherein the position control system can be switched between an active mode, in which a position of the gripping device with respect to the base structure is actively controlled, and a passive mode, in which the gripping device is allowed to freely move with respect to the base structure within limits of freedom of movement provided by the position control system.

18. The lifting device of any of the clauses 15-17, wherein the position control system is configured to control a position of the gripping device in three degrees of freedom, preferably in six degrees of freedom.

19. The lifting device of any of the clauses 15-18, wherein the at least one actuator is an assembly of hydraulic actuators to move the gripping device with respect to the base structure.

20. The lifting device of any of the preceding clauses, wherein the gripping device comprises a main body and at least one shell element rotatably mounted to the main body, wherein the at least one shell element is movable between a closed position, in which the at least one shell element and the main body enclose a leg receiving space to receive a leg therein, and an open position in which a leg can be brought into or taken out of the leg receiving space.

21. The lifting device of any of the preceding clauses, wherein the gripping device is configured to grip the leg to allow the lifting of the leg.

22. The lifting device of any of the preceding clauses, wherein the gripping device comprises multiple drill elements configured to be drilled in the leg in order to grip the leg.

23. The lifting device of the preceding clause, wherein the gripping device comprises a temporary clamping device to clamp the leg at least before and during drilling of the drill elements into the leg.

24. A method of lifting a leg of at least one part of a sea platform comprising a support structure and a top side, the method comprising the steps of:

providing a lifting device as claimed in any of the preceding clauses, moving the lifting device towards the leg, positioning by a positioning device the gripping device on the leg and gripping the leg, moving the base structure upwards to support the lifting beam at the support location of the support device, and moving the base structure upwards to lift the leg.

25. The method of clause 24, wherein positioning of the gripping device comprises one or more of the steps of:

actively controlling, by a position control system in an active mode, the position of the gripping device, in particular in order to compensate for motions of the base structure, such as wave-induced motions of the base structure during positioning of the gripping device on the leg and/or gripping the leg;

switching from an active mode to a passive mode after positioning of the gripping device on the leg and/or gripping the leg, wherein in the passive mode the gripping device is allowed to freely move with respect to the base structure within limits of freedom of movement provided by the position control system.

26. The method of clause 24 or 25, wherein gripping the leg comprises one or more of the steps of:

wherein the gripping device comprises a main body and at least one shell element pivotably mounted to the main body, wherein the at least one shell element is movable between an open position in which a leg can be brought into or taken out of a leg receiving space, and a closed position, in which the shell element together with the main body encloses the leg receiving space to receive a leg therein, and receiving the leg in the leg receiving space when the shell element is in the open position and moving the at least one shell element to the closed position to enclose the leg in the leg receiving space;

drilling multiple drill elements of the gripping device into the leg to grip the leg; and/or temporary clamping with a temporary clamping device to clamp the leg at least before and during drilling of the drill elements into the leg.

27. The method of any of the clauses 24-26, wherein moving the base structure upwards to support the lifting beam at the support location of the support device, comprises one or more of the steps of:

moving the lifting beam with respect to the support device from a non-supporting position, in which a support element of the lifting beam is spaced from the support location to a supporting position, in which the support element is located at the support location.

28. A vessel for removal and/or installation of at least one part of a sea platform comprising a support device and a top side, said vessel comprising a hull and two support arms located at a distance from each other and attached to the hull, wherein the support arms in use extend beyond the hull in a substantially horizontal direction, wherein each of the support arms carries at least one lifting device as claimed in any of the clauses 1-23.

29. The vessel of clause 28, wherein the vessel comprises a ballast system constructed and arranged to lower and raise the vessel relative to the water surface.

30. A method for lifting at least one part of a sea platform using a vessel as claimed in clause 28 or 29, comprising the steps of:

positioning the support arms at opposite sides of the sea platform;

positioning by a positioning device multiple gripping devices on multiple legs and gripping the multiple legs, raising the support arms to support the lifting beam at the support location of the support device, transferring substantially all load to the support arms, and raising the support arms to lift the at least one part of the sea platform.

31. The method of clause 30, wherein raising the support arms comprises releasing ballast water from ballast tanks of a ballast system of the vessel, in particular dumping ballast water.

The invention claimed is:

1. A lifting device for lifting a leg of at least one part of a sea platform comprising a support structure and a top side, wherein the lifting device comprises:

a base structure to be mounted on a vessel;

a gripping device to grip the leg, wherein the gripping device is movably supported with respect to the base structure;

a support device mounted on the base structure, and a lifting beam, wherein a first end of the lifting beam is configured to be supported at a support location of the support device and wherein a second end of the lifting beam opposite to the first end is configured to be connected to the gripping device, wherein the lifting beam comprises a support element to cooperate with the support location of the support device, wherein the lifting beam and the support device are movable with respect to each other between a supporting position, in which the support element is located at the support location, and a non-supporting position, in which the support element is spaced from the support location.

2. The lifting device according to claim 1, wherein the support element is a support pin and wherein the support location is formed by a support saddle for the support pin.

3. The lifting device according to claim 1, wherein the lifting device comprises a positioning device for positioning the gripping device with respect to the leg.

4. The lifting device according to claim 3, wherein the positioning device comprises a position control system to actively control the position of the gripping device in particular in order to compensate for motions of the base structure.

5. The lifting device according to claim 4, wherein the position control system comprises:

at least one sensor to determine a position of the gripping device with respect to the base structure;

a controller to provide one or more actuation signals on the basis of the determined position; and at least one actuator to actuate on the gripping device to control a relative position of the gripping device with respect to the base structure.

6. The lifting device according to claim 1, wherein the gripping device comprises a main body and at least one shell element rotatably mounted to the main body, wherein the at least one shell element is movable between a closed position, in which the at least one shell element and the main body enclose a leg receiving space to receive a leg therein, and an open position in which a leg can be brought into or taken out of the leg receiving space.

7. The lifting device according to claim 1, wherein the gripping device is configured to grip the leg to allow the lifting of the leg.

8. The lifting device according to claim 1, wherein the gripping device comprises multiple drill elements configured to be drilled in the leg in order to grip the leg.

9. A method of lifting a leg of at least one part of a sea platform comprising a support structure and a top side, the method comprising the steps of:

providing a lifting device as claimed in claim 1;

moving the lifting device towards the leg;

positioning by a positioning device the gripping device on the leg and gripping the leg;

moving the base structure upwards to support the lifting beam at the support location of the support device; and moving the base structure upwards to lift the leg.

10. The method according to claim 9, wherein positioning of the gripping device comprises one or more of the steps of:

actively controlling, by a position control system in an active mode, the position of the gripping device to compensate for wave-induced motions of the base structure during positioning of the gripping device on the leg and/or gripping the leg; and switching from an active mode to a passive mode after positioning of the gripping device on the leg and/or gripping the leg, wherein in the passive mode the gripping device is allowed to freely move with respect to the base structure within limits of freedom of movement provided by the position control system.

11. The method according to claim 9, wherein gripping the leg comprises one or more of the steps of:

wherein the gripping device comprises a main body and at least one shell element pivotably mounted to the main body, wherein the at least one shell element is movable between an open position in which a leg can be brought into or taken out of a leg receiving space, and a closed position, in which the shell element together with the main body encloses the leg receiving space to receive a leg therein, and receiving the leg in the leg receiving space when the shell element is in the open position and moving the at least one shell element to the closed position to enclose the leg in the leg receiving space;

drilling multiple drill elements of the gripping device into the leg to grip the leg; and/or temporary clamping with a temporary clamping device to clamp the leg at least before and during drilling of the drill elements into the leg.

12. The method according to claim 9, wherein moving the base structure upwards to support the lifting beam at the support location of the support device, comprises one or more of the steps of:

moving the lifting beam with respect to the support device from the non-supporting position, in which the support element of the lifting beam is spaced from the support location to the supporting position, in which the support element is located at the support location.

13. A vessel for removal and/or installation of at least one part of a sea platform comprising a support device and a top side, said vessel comprising a hull and two support arms located at a distance from each other and attached to the hull, wherein the support arms in use extend beyond the hull in a substantially horizontal direction, wherein each of the support arms carries at least one lifting device as claimed in claim 1.

14. The vessel according to claim 13, wherein the vessel comprises a ballast system constructed and arranged to lower and raise the vessel relative to the water surface.

15. A method for lifting at least one part of a sea platform using a vessel as claimed in claim 13, comprising the steps of:

positioning the support arms at opposite sides of the sea platform;

positioning by a positioning device multiple gripping devices on multiple legs and gripping the multiple legs;

raising the support arms to support the lifting beam at the support location of the support device;

transferring substantially all load to the support arms; and raising the support arms to lift the at least one part of the sea platform.

16. The lifting device according to claim 1, wherein the lifting device comprises elastic or flexible elements to provide, in a supporting state of the lifting device, freedom of movement of the gripping device with respect to the base structure.

17. The lifting device according to claim 16, wherein, in the supporting state of the lifting device, the support device and/or lifting beam is provided with a device providing spring characteristics to provide freedom of movement of the gripping device with respect to the base structure in the horizontal plane and/or in the vertical direction.

18. The lifting device according to claim 16, wherein, in the supporting state of the lifting device, the lifting beam is arranged as a pendulum to allow movement of the second end of the lifting beam in a substantially horizontal plane with respect to the support location.

19. The lifting device according to claim 16, wherein elastic elements, in particular elastic blocks, are provided within the support device or between the support device and the base structure to allow relative movement of at least part of the support device with respect to the base structure to allow at least a substantially vertical movement of the support location with respect to the base structure.

20. A lifting device for lifting a leg of at least one part of a sea platform comprising a support structure and a top side, wherein the lifting device comprises:

a base structure to be mounted on a vessel;

a gripping device to grip the leg, wherein the gripping device is movably supported with respect to the base structure;

a support device mounted on the base structure;

a lifting beam, wherein a first end of the lifting beam is configured to be supported at a support location of the support device and wherein a second end of the lifting beam opposite to the first end is configured to be connected to the gripping device; and a positioning device for positioning the gripping device with respect to the leg, wherein the positioning device comprises a position control system to actively control the position of the gripping device to compensate for motions of the base structure, wherein the position control system comprises:

at least one sensor to determine a position of the gripping device with respect to the base structure;

a controller to provide one or more actuation signals on the basis of the determined position; and at least one actuator to actuate on the gripping device to control a relative position of the gripping device with respect to the base structure.

21. A lifting device for lifting a leg of at least one part of a sea platform comprising a support structure and a top side, wherein the lifting device comprises:

a base structure to be mounted on a vessel;

a gripping device to grip the leg, wherein the gripping device is movably supported with respect to the base structure, and wherein the gripping device comprises multiple drill elements configured to be drilled in the leg in order to grip the leg;

a support device mounted on the base structure; and a lifting beam, wherein a first end of the lifting beam is configured to be supported at a support location of the support device and wherein a second end of the lifting beam opposite to the first end is configured to be connected to the gripping device.

* * * * *